US005481832A

United States Patent [19]

Tirikos

[11] Patent Number: 5,481,832

[45] Date of Patent: Jan. 9, 1996

[54] BRIDGE SAND BLASTING SUPPORT APPARATUS

[76] Inventor: Steven M. Tirikos, 278 Gordon Ave., Campbell, Ohio 44405

[21] Appl. No.: 126,219

[22] Filed: Sep. 23, 1993

[51] Int. Cl.[6] ..... B24C 1/00

[52] U.S. Cl. ..... 451/75; 451/87; 451/88; 451/89; 451/92

[58] Field of Search ..... 51/410, 424, 425, 51/428, 429, 426, 319, 320, 321

[56] References Cited

U.S. PATENT DOCUMENTS

| | | | |
|---|---|---|---|
| 2,729,918 | 1/1956 | Denburgh | 51/429 |
| 2,869,291 | 1/1959 | Clay | 51/14 |
| 3,262,228 | 7/1966 | Schenck | 51/429 |
| 3,664,459 | 5/1972 | Stephens et al. | 182/141 |
| 3,747,277 | 7/1973 | Carpenter et al. | 51/425 |
| 3,788,010 | 1/1974 | Goff | 51/425 |
| 3,934,372 | 1/1976 | Diehn et al. | 51/425 |
| 4,060,148 | 11/1977 | Sidney | 182/2 |
| 4,074,790 | 2/1978 | Colbachini et al. | 182/63 |
| 4,137,994 | 2/1979 | Wood | 182/2 |
| 4,333,275 | 6/1982 | Bernet | 51/425 |
| 4,787,179 | 11/1988 | Lewis | 51/426 |
| 4,852,307 | 8/1989 | Goudeau | 51/319 |
| 4,953,666 | 9/1990 | Ridings | 187/9 R |
| 5,011,710 | 4/1991 | Harrison | 427/142 |
| 5,212,911 | 5/1993 | Benson | 51/410 |
| 5,228,534 | 7/1993 | Haroldson, Sr. | 182/63 |
| 5,1085,968 | 2/1993 | Lyras | 51/319 |

FOREIGN PATENT DOCUMENTS

| | | | |
|---|---|---|---|
| 0095232 | 11/1983 | European Pat. Off. | B24C 3/06 |
| 2193454 | 2/1988 | United Kingdom | B24C 3/06 |
| 8403247 | 8/1984 | WIPO | B24C 3/06 |

OTHER PUBLICATIONS

Valenti, Michael, "Cutting Sandblasting Costs," *Mechanical Engineering*, Mar. 1993, p. 34.

*Primary Examiner*—Maurina T. Rachuba
*Attorney, Agent, or Firm*—Thomas M. Champagne; Jon L. Roberts; Roberts & Associates

[57] ABSTRACT

A series of large bins which can be raised and lowered on lifts in order to reach a bridge that is to be sand blasted. A skirt is attached to the upper outside edges of the bins. This skirt is raised and attached to the bridge so that the entire work area is completely enclosed. An air inlet and an air outlet are provided at either end of the enclosed work area. Air is pumped in to the work space through the inlet and is evacuated through the outlet. The outlet pressure is maintained at a higher level than that of the inlet in order to maintain a negative air pressure inside the work area relative to the outside air pressure. A grate covers each bin, providing an area on which workers can stand. As the bridge is sand blasted, all paint debris and blasting sand falls through the grates and into the bins. Smaller particles of dust are removed from the work area through the air outlet and are collected by a dust filter. The lifts are independently controllable, so that the bins can be raised such that the grates are parallel to the supporting road surface or such that they are tilted at an angle with respect to this surface. The bins and lifts are mounted on the bed of a trailer for easy mobility. All debris collected by the bins is removed at a valved outlet at the bottom of each bin.

19 Claims, 2 Drawing Sheets

BRIDGE SAND BLASTING SUPPORT APPARATUS

FIELD OF THE INVENTION

The present invention relates generally to a support apparatus for machines used to blast the surface of structures with a granulated material such as sand in order to remove paint from the structure. Such sand blasting is done in order to prepare the surface of the structure for a new coating of paint. In particular, the present invention relates to a support apparatus for workers using sand blasting equipment used to remove paint from bridges and roadway overpasses.

BACKGROUND OF THE INVENTION

The removal of lead based paint from bridges and highway overpasses is now mandated by federal and state authorities. Sand blasting is the most efficient and commonly used method of removing this paint in order to prepare the bridges for repainting with a nontoxic coating. For example, U.S. Pat. No. 2,869,291 to Clay discloses a mobile shot blasting machine that may be used to remove paint from a roadway bridge.

Sand blasting, however, sends paints chips flying and leaves a large residue of sand grains and leaded dust. This debris should be contained and collected to the greatest extent possible. According to the March, 1993 issue of *Mechanical Engineering*, sandblasting a single medium sized highway bridge will typically generate 800 tons of grit having an untreated disposal cost of $400,000. Effectively containing the debris cuts down on the disposal cost, as scattered debris does not need to be collected. Separating the paint waste and lead dust from the used blasting sand so that the sand can be recycled also cuts down on the cost of the overall operation.

U.K. Patent Application GB 2 193 454 A to Auto Truck Cleaning Ltd. discloses a mobile shot blast cleaning apparatus that collects all used blasting shot and paint residue. The apparatus has a special nozzle that is connected to a flexible conduit which supplies pressurized shot to the nozzle, and to an outlet pipe that draws used shot and paint debris from the nozzle. While this apparatus is efficient at collecting the waste materials, it is not suitable for use in removing paint from a highway bridge as the nozzle only allows processing of a small area. Further, ladders or scaffolding would be necessary in order to reach the bridge with the nozzle.

In order to contain the debris as it is blasted from the bridge, a heavy curtain is usually hung around the work area, reaching to the ground below. This curtain encircles the work area of the bridge on all sides during the sand blasting procedure. For example, U.S. Pat. No. 4,852,307 to Goudeau discloses a shroud that is placed over the object to be sandblasted, along with inflatable collection baskets for retrieving sandblasted cuttings.

In order to collect small lead dust particles present in the air during blasting, air inlets and outlets connected to fans are usually employed to continually replace the air in the curtained work area. Because the work area is a large enclosed space spanning a section of the bridge from bridge level to the ground below, many high powered fans are necessary to keep the air recirculating sufficiently. The number and power of such fans is directly related to the volume of work space enclosed by the curtains. Providing and operating these fans is a substantial contribution to the overall expense incurred in a sand blasting operation.

For example, U.S. Pat. No. 4,787,179 to Lewis discloses an abrasive blasting containment system having a complex air circulation system. Air is pumped into an enclosed room through an inlet having diffusers which minimize air turbulence. Air return ducts are utilized to draw air out of the room. Items to be sandblasted are brought into the room where a worker applies a sand blasting apparatus.

Because a highway bridge cannot be brought into a room to be sand blasted, erection of a curtain and sand blasting of a bridge currently requires the use of scaffolding or similar structures. The scaffolding is placed on the ground below the bridge, providing support for the curtain and allowing workers to reach the bridge. This scaffolding must sometimes be placed directly on the roadway running beneath the bridge or overpass. Because this can cause traffic congestion on the roadway, sand blasting often takes place at night.

Setting up the scaffolding, curtain, and blasting equipment takes a considerable amount of time and manpower using conventional systems. An alternative to scaffolding is disclosed in U.S. Pat. No. 5,011,710 to Harrison. This patent discloses a walkway within an enclosure that can be suspended from a structure. Workers on the walkway sand blast the structure, and a vacuum conveyor collects and removes particles resulting from the blasting procedure. This apparatus has less effect on traffic than scaffolding does, but requires a great deal of time to set up and mount on a bridge. Breakdown of the apparatus is time consuming as well.

Moving the scaffolding setup as work progresses is also a time consuming operation. Local authorities often limit the night time hours that a sand blasting crew is allowed to work so that rush hour traffic is not impeded. Under these restrictions, it is often the case that set up and break down times for the operation are significantly longer than the time that sand blasting actually takes place. Part of this time involves cleanup and removal of toxic lead chips and dust from the roadway and surrounding area. Thus, a sand blasting job using conventional equipment is an inefficient task. Decreasing environmental pollution from said blasting jobs is a key goal. Further, decreasing the time it takes to set up and break down the sand blasting apparatus would dramatically increase the productivity of such a job thereby allowing more lead based paint to be removed in a given amount of time.

SUMMARY OF THE INVENTION

It is therefore an object of the present invention to provide a sand blasting apparatus for bridges and overpasses that can be set up and broken down in a short amount of time.

It is a further object of the present invention to provide a sand blasting apparatus for bridges and overpasses that does not require moving from one section of the bridge to another as work progresses.

It is an additional object of the present invention to provide a sand blasting apparatus for bridges and overpasses that can tilt in order to adapt to the geometry of the bridge and the ground below.

It is another object of the present invention to provide a sand blasting apparatus for bridges and overpasses that is efficient in collecting paint chip debris and blasting sand residue.

It is a further object of the present invention to provide a sand blasting apparatus for bridges and overpasses that has a smaller enclosed work area volume, minimizing the volume of air that must be cleaned during the sand blasting procedure.

These and other objects and advantages of the present invention will be apparent to those of ordinary skill in the art upon inspection of the detailed description, drawings, and appended claims.

The present invention comprises a series of large bins which can be raised and lowered on lifts or jacks. Preferably, the work surface of the bins is ten feet square (to conform to ten foot lane widths) and the bins are raised and lowered on hydraulic jacks in order to reach the bridge that is to be sand blasted. A skirt is attached to the upper outside edges of the bins. This skirt is raised and attached to the bridge so that the entire work area is completely enclosed.

An air inlet and an air outlet are provided at either end of the enclosed work area. Air is pumped in to the work space through the inlet, preferably at a rate of 12,000 cubic feet per minute (CFM) and is evacuated through the outlet, preferably at a rate of 18,000 CFM. The outlet pressure is maintained at a higher level than that of the inlet in order to maintain a negative air pressure inside the work area relative to the outside air pressure. Because the skirt defining the work area spans from the bridge to the top edges of the bins, rather than to the ground surface below, the work volume is considerably smaller than that of a conventional sand blasting apparatus. Smaller, lower powered fans are therefore sufficient in order to replace the air within the work area, providing considerable cost savings.

A grate covers each bin, providing an area on which workers can stand. As the bridge is sand blasted, all paint debris and blasting sand falls through the grates and into the bins. Smaller particles of dust are removed from the work area through the air outlet and are collected by a dust filter.

The hydraulic jacks are independently controllable, so that the bins can be raised such that the grates are parallel to the supporting road surface or such that they are tilted at an angle with respect to this surface. In this way, the present invention can accommodate bridges that are at an angle with respect to the supporting roadway or that form an angle with a banked roadway.

The bins and lifts are mounted on the bed of a 50 foot trailer for easy mobility. Thus, not only are set up and break down times dramatically decreased by doing away with the scaffolding erection process, but the entire apparatus can be quickly raised into place and lowered and removed each day to minimize traffic disruption. Because all debris and sand is collected in the bins or in the dust filter, clean up time is reduced as well. All debris collected by the bins is removed at a valved outlet at the bottom of each bin.

DETAILED DESCRIPTION

Figure 1:
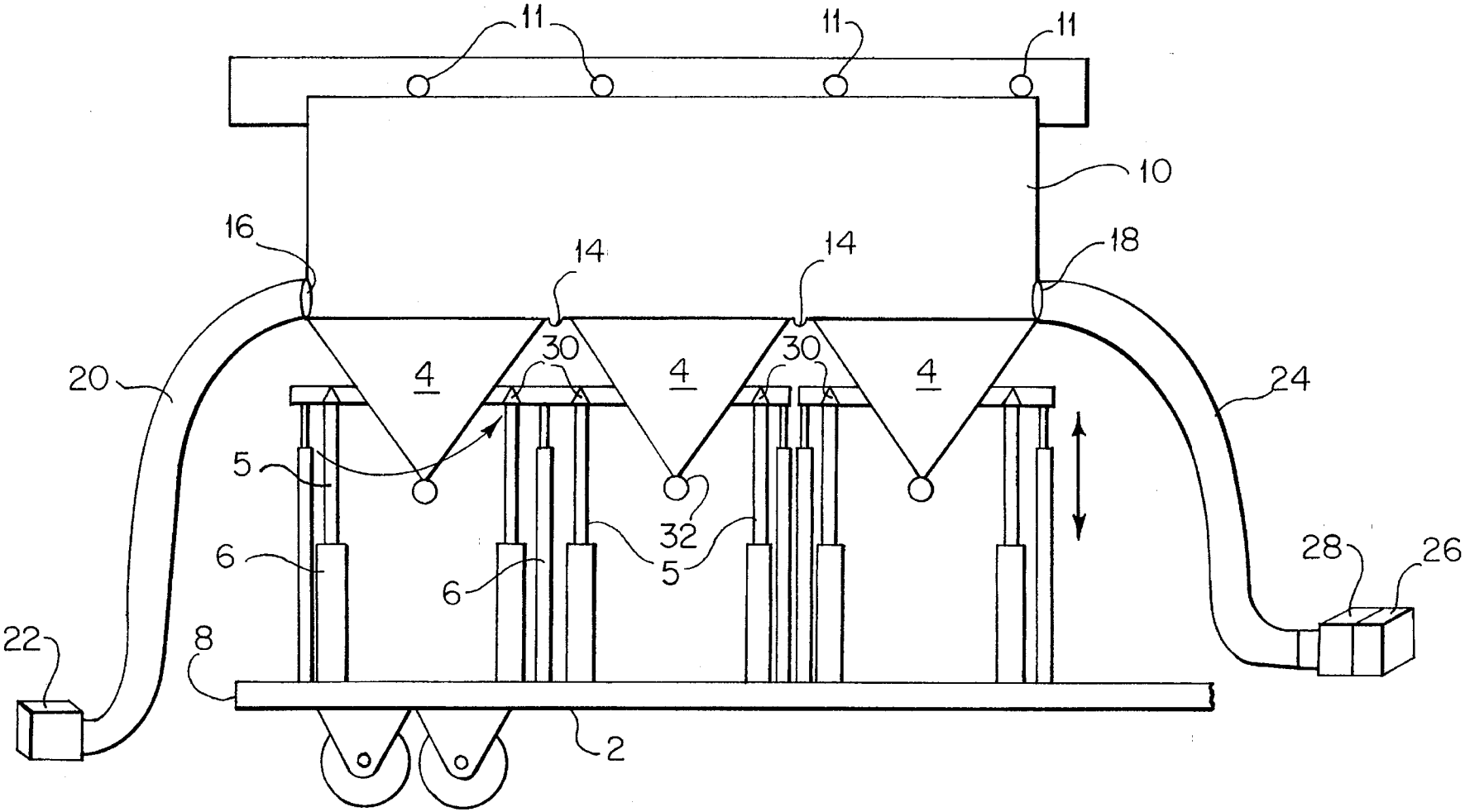
FIG. 1 shows a side view of the bridge sand blasting apparatus.

Referring to FIG. 1, a side view of the bridge sand blasting apparatus 2 is shown. As shown, a plurality of large bins 4 are mounted on lift arms 5 driven by lifts 6 or jacks, which are in turn mounted on a trailer bed 8. As shown, the bins 4 preferably have the shape of inverted, square-based pyramids 10 feet square and 6 feet deep, with extensions to make the mounting connection with the lift arms. The lift arms 5 on which the bins 4 are mounted are preferably of the well known hydraulic type. When the apparatus 2 is in use, supports may be provided for the trailer 8 to prevent tipping of the apparatus 2.

When the trailer 8 supporting the bins 4 is parked below the bridge to be sand blasted, the lifts 6 raise the bins up to a level close to the bridge, so that the sand blasting can be more effectively performed. The lift arms 5 may be fitted with pins or other locking means to secure the lift arms 5 in place once a desired height is reached. Once a bin 4 is raised to the proper level, a skirt 10 can be put into place. This skirt 10 is a flexible sheet of material, the bottom edge of which is attached to the bins 4 at the outer top edges of the bins 4. That is, the skirt 10 is attached to all bin top edges except for those facing an adjacent bin. In this way, the skirt 10 forms a continuous sheet that encircles the upper facing surfaces of all the bins 4.

When the skirt 10 is raised, the skirt 10 encloses the upper facing surfaces of all the bins 4. The top edge of the skirt 10 is then attached to the bridge using some type of attachment means 11. Because bridges are made primarily of steel, the preferred means for attaching the skirt 10 be to the bridge is by means of magnets attached in or on the top edge of the skirt 10. These magnets will removably attach to the steel portions of the bridge, holding the skirt up.

Figure 2:
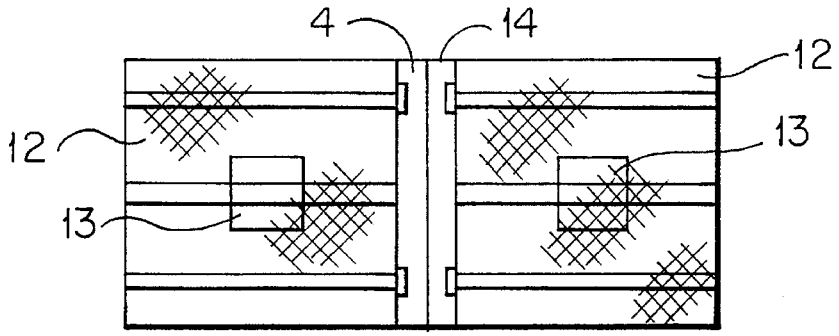
FIG. 2 shows a top view of two grates covering two adjacent bins.

The bins 4 are hollow and have an open top face. The open top face of each bin is covered by a grate 12. Referring to FIG. 2, an example of such a grate 12 is shown. This grate 12 is preferably made of steel reinforced mesh. The grate 12 covers the top face of the bin 4 and provides a place for sand blast workers to stand. Paint debris and blasting sand fall through openings in the grates 12 and collect in the bins 4. A hinged door or other closable opening 13 may be provided in the grate 12 to allow access to the interior of the bin 4.

When the skirt 10 is raised into place and is attached to the bridge, the skirt 10, grates 12, and the bridge define the sand blast work area. A hinged panel 14 is attached to the facing top edges of adjacent bins. In the open position, the hinged panel 14 covers any gaps that exist between adjacent bins 4 so that the work area remains substantially air tight. A single hinged panel on one bin may span the gap, or two hinged panels, one on each adjacent bin, may be used to span the gap.

The skirt 10 is provided with two ports 16 and 18. The first port, an air inlet 16, is connected via a first passage means such as a duct to a first fan 22 or other air supply means, which blows air from outside the work area into the work area. The second port is an air outlet 18. The air outlet 18 is connected via a second passage means 24 such as a duct to a second fan 26 or air evacuation means, which draws air from the work area. Preferably, the second fan 26 provides a greater air pressure than the first fan 22, in order to keep the pressure within the work area at a lower level than that of the air outside the work area. Preferably, the first fan 22 adds about 12,000 cubic feet per minute of air to the work area, while the second 26 fan draws 18,000 cubic feet per minute of air from the work area.

Figure 3:
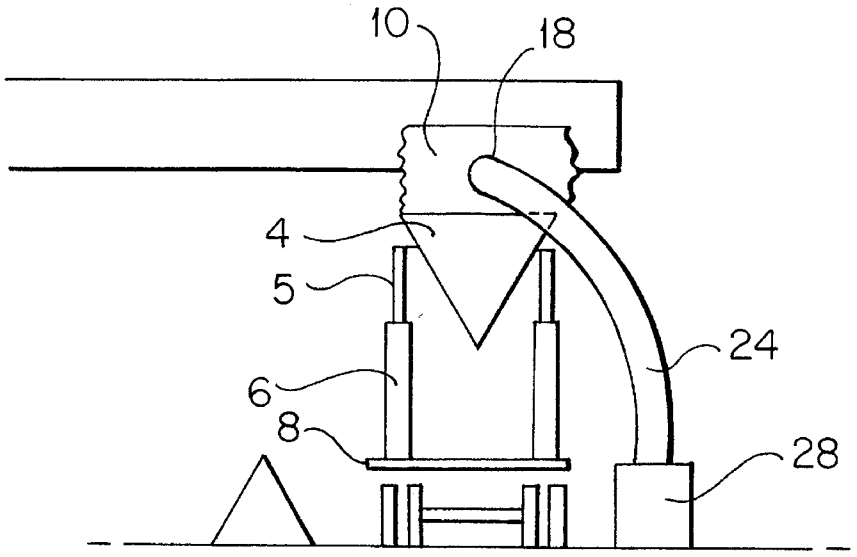
FIG. 3 shows an end view of the bridge sand blasting apparatus with the work area skirt and dust collector in place.

Referring to FIG. 3, an end view of the bridge sand blasting apparatus with the work area skirt and a dust collector 28 in place is shown. Because of the pressure differential between the air inlet 16 and the air outlet 18 provided by the two fans 22 and 26, all small particles of dust in the air within the work area are drawn to the second fan 26 through the second passage means 24. The air passing through the second passage means 24 from the air outlet 18 passes through a dust collector 28 before being released to the outside air. The dust collector 28 is a filter means which traps and collects the dust suspended in the air. The dust collector 28 can be placed anywhere in the outlet air path defined by the air outlet, the second passage means, and both sides of the second fan.

Figure 4:
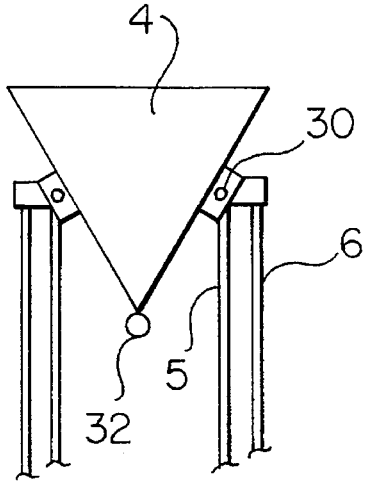
FIG. 4 shows a view of a pivot point.

The hydraulic lifts 6 that are used to raise and lower the bins 4 operate independently of each other. Thus, the different lift arms 5 may be adjusted to different heights, providing a tilt angle to the top faces of the bins 4. This tilt angle allows the sand blasting apparatus 2 to more closely conform to the particular relative geometric configuration of the bridge and the ground or support roadway below. Tilting of the bins 4 is also made possible by pivot points 30 at the locus of connection of the bins 4 and the lift arms 5, as shown in FIG. 4. This pivotal connection between the bins 4 and each lift 6 allows a wide range of tilt angles for each individual bin 4. If desired, the lifts 6 may also operate in pairs. The drive motor for the lifts 6 may be mounted under the trailer 8.

The contents of the bins 4 can be emptied through valved outlets 32 located at the bottom of each bin 4. Paint debris and used blasting sand is emptied through this valved outlet 32, enabling easy post blasting cleanup. The collected contents of the bins 4 may later be separated so that the paint debris may be disposed of and the blasting sand may be recycled. The bins 4 may also be fitted with foldable rails along the outer top edges. These rails can hang down from the tops of the bins 4 when not in use. When the apparatus 2 is set up, the rails may be locked into place for safety purposes. The rails may be necessary to conform to OSHA standards.

The following is an example of the efficacy of the operation of the present invention. Using conventional scaffold and curtain techniques, set up for a typical overpass blasting operation takes about four hours and comprises erecting the scaffold, erecting and sealing the protective curtain, and attaching fans. Cleanup and breakdown takes about the same amount of time since removal of leaded debris must be done carefully. State and local authorities generally only allow eight hours of nighttime operations. As a result sand blasting occurs only for a very brief time or traffic is congested as a result of operations lasting beyond the allotted time.

In contrast, the present invention is moved into place, raised into position, and has the skirt attached to the bridge in approximately 15 minutes. A similar amount of time is required to disassemble and lower the apparatus. The need for cleanup following breakdown is virtually nonexistent. Thus, seven hours of productive time may be achieved with very little environmental or traffic impact.

Preferred and alternate embodiments of the present invention have now been described in detail. It is to be noted, however, that this description of these specific embodiments is merely illustrative of the principles underlying the inventive concept. It is therefore contemplated that various modifications of the disclosed embodiments will, without departing from the spirit and scope of the invention, be apparent to persons skilled in the art.

What is claimed is:

1. A bridge sand blasting support apparatus, comprising:

A) a bin having a hollow interior, an open top face, and outer top edges;

B) a trailer;

C) support means mounted to the trailer and on which the bin is mounted, for supporting the bin;

D) a grate covering the open top face of the bin;

E) a skirt having a top edge and a bottom edge, the bottom edge being attached to the outer top edges of the bin such that the skirt forms a continuous sheet encircling the open top face of the bin; and F) attachment means on the top edge of the skirt for removably attaching the top edge of the skirt to the bridge;

G) the grate, the skirt and the bridge defining a work area.

2. The apparatus of claim 1, wherein:

A) the support means comprises a plurality of lift arms;

B) the apparatus further comprising a plurality of lifts for causing the lift arms to raise and lower the bin with respect to the trailer.

3. The apparatus of claim 1, wherein the work area is minimized in volume by raising of the bin.

4. The apparatus of claim 2, wherein the bin is pivotally mounted on the lift arms.

5. The apparatus of claim 4, wherein the lifts operate independently of each other so that each lift arm may be raised to a height that is different from the height of another lift arm, enabling the bins to be tilted.

6. The apparatus of claim 1, wherein:

A) the skirt comprises a first port and a second port;

B) the first port being connected via a first passage means to an air supply means which blows air into the work area;

C) the second port being connected via a second passage means to an air evacuation means which draws air from the work area;

D) the second port, second passage means, and air evacuation means defining an outlet air path; and E) the air evacuation means providing a greater air pressure than the air supply means provides.

7. The apparatus of claim 6, further comprising a filter means connected to the apparatus in the outlet air path, for trapping and collecting dust suspended in air within the outlet air path.

8. The apparatus of claim 1, wherein the bin further comprises a valved outlet.

9. The apparatus of claim 1, wherein the bin has a shape resembling an inverted pyramid with a ten foot square base.

10. The apparatus of claim 1, wherein the attachment means comprises magnets.

11. The apparatus of claim 1, wherein the grate comprises a closable opening for providing access to the hollow interior of the bin.

12. The apparatus of claim 1, further comprising:

A) a second bin mounted on the trailer next to the bin, the bin and the second bin having facing top edges with a gap therebetween;

B) a first hinged panel attached to the facing top edge of the bin; and

C) a second hinged panel attached to the facing top edge of the second bin;

D) the first hinged panel and the second hinged panel being positioned such that the gap is covered by the first hinged panel and the second hinged panel when the first hinged panel and the second hinged panel are in an open position.

13. A bridge sand blasting support apparatus, comprising:

A) a plurality of bins, each having a hollow interior, an open top face, a valved outlet, and outer top edges;

B) a trailer;

C) a plurality of lift arms mounted to the trailer and on which the bins are mounted such that the bins are arranged in a row with adjacent bins having facing top edges with gaps therebetween;

D) a plurality of lifts for causing the lift arms to raise and lower the bins with respect to the trailer;

E) a plurality of grates, one grate covering the open top face of each bin;

F) a skirt having a top edge and a bottom edge, the bottom edge being attached to the outer top edges of the bins such that the skirt forms a continuous sheet encircling the open top faces of the bins;

G) attachment means on the top edge of the skirt for removably attaching the top edge of the skirt to the bridge; and H) a hinged panel attached to the facing top edge of each bin, the hinged panel positioned such that the gap is covered by the hinged panel when the hinged panel is in an open position;

I) the grates, the skirt and the bridge defining a work area, the work area being minimized in volume by raising of the bins.

14. The apparatus of claim 13, wherein:

A) the bin is pivotally mounted on the lift arms; and

B) the lifts operate independently of each other so that each lift arm may be raised to a height that is different from the height of another lift arm, enabling the bins to be tilted.

15. The apparatus of claim 13, wherein:

A) the skirt comprises a first port and a second port; and

B) the apparatus further comprises a first passage means, a second passage means, an air supply means, an air evacuation means, and a filter means;

C) the first port being connected via the first passage means to the air supply means, which blows air into the work area;

D) the second port being connected via the second passage means to the air evacuation means, which draws air from the work area;

E) the second port, second passage means, and air evacuation means defining an outlet air path;

F) the filter means being connected to the apparatus in the outlet air path, for trapping and collecting dust suspended in air within the outlet air path; and G) the air evacuation means providing a greater air pressure than the first air supply provides.

16. The apparatus of claim 13, wherein each bin has a shape resembling an inverted pyramid with a ten foot square base.

17. The apparatus of claim 13, wherein the attachment means comprises magnets.

18. The apparatus of claim 13, wherein the grate comprises a closable opening for providing access to the hollow interior of the bin.

19. The apparatus of claim 14, wherein:

A) the skirt comprises a first port and a second port; and

B) the apparatus further comprises a first passage means, a second passage means, an air supply means, an air evacuation means, and a filter means;

C) the first port being connected via the first passage means to the air supply means, which blows air into the work area;

D) the second port being connected via the second passage means to the air evacuation means, which draws air from the work area;

E) the second port, second passage means, and air evacuation means defining an outlet air path;

F) the filter means being connected to the apparatus in the outlet air path, for trapping and collecting dust suspended in air within the outlet air path; and G) the air evacuation means providing a greater air pressure than the first air supply provides.

* * * * *